United States Patent [19]

Hattori et al.

[11] Patent Number: 4,674,376

[45] Date of Patent: Jun. 23, 1987

[54] AUTOMATIC CUTTING APPARATUS FOR EXTRUSION MOLDED BODIES

[75] Inventors: Isao Hattori, Nagoya; Akio Enomoto, Aichi, both of Japan

[73] Assignee: NGK Insulators, Ltd., Japan

[21] Appl. No.: 840,087

[22] Filed: Mar. 17, 1986

[30] Foreign Application Priority Data

Apr. 16, 1985 [JP] Japan ..... 60-79352

[51] Int. Cl.[4] ..... B26D 1/60

[52] U.S. Cl. ..... 83/285; 425/142; 83/310; 83/318

[58] Field of Search ..... 83/285, 310, 319, 318; 422/142, 315, 312

[56] References Cited

U.S. PATENT DOCUMENTS 3,267,786 8/1966 Kats ..... 83/318

FOREIGN PATENT DOCUMENTS 1552569 1/1970 Fed. Rep. of Germany ..... 83/319
57-59100 4/1982 Japan .
59-110606 7/1984 Japan .
59-114906 8/1984 Japan .
59-122208 8/1984 Japan .
558243 1/1975 Switzerland ..... 425/142

*Primary Examiner*—Bernard Nozick
*Attorney, Agent, or Firm*—Parkhurst & Oliff

[57] ABSTRACT

An automatic cutting apparatus for extrusion molded bodies is disclosed, which comprises support base supply means for supplying support bases just beneath the extrusion molded body extruded from an extruder and transferring them onto a transporting passage, a speed sensor for detecting a moving speed of the body on the support bases, interval detecting means provided midway on the transporting passage for detecting a cutting interval for the body, and cutting means including a cutting tool arranged on the transporting passage upstream of the interval detecting means for cutting the body into a predetermined length perpendicularly to a moving direction of the body with the cutting tool being moved in the moving direction at a speed equal to that of the body detected by the speed sensor in response to a signal detected by the interval detecting means.

3 Claims, 10 Drawing Figures

AUTOMATIC CUTTING APPARATUS FOR EXTRUSION MOLDED BODIES

BACKGROUND OF THE INVENTION

1. Field of the Invention

This invention relates to an automatic cutting apparatus for extrusion molded bodies which can automatically cut an extrusion molded body extruded from an extruder into a predetermined length.

2. Related Art Statement

In articles manufactured through extrusion molding such as ceramic honeycomb structures and the like, there is a step for separating into single parts by cutting an extrusion molded body continuously extruded from an extruder into a predetermined length.

Heretofore, such a cutting of the extrusion molded body has almost been performed by manual operation of skilled workers. Because, the extrusion molded body is soft, and particularly the ceramic honeycomb structure is very minute in the shape and has a very thin thickness of partition wall, so that it is very difficult to flatly cut the extrusion molded body without breaking its shape and there is yet existent no proper cutting apparatus. Therefore, the cutting operation was usually carried out by the worker through an extreme fine steel wire and a jig.

In the cutting of the extrusion molded body through manual operation as mentioned above, however, the operation efficiency is low in case of mass production, and also the long time is required for mastering the technique and further there are problems in view of the yield.

Moreover, the automation of the above cutting operation is difficult due to the fact that the extrusion molded body is soft. In addition, since the extrusion molded body is extruded from the extruder and moves off therefrom, when it is simply cut at a plane perpendicular to the moving direction, the cut surface becomes slanting with the moving, which is also a cause of obstructing the automation.

SUMMARY OF THE INVENTION

It is, therefore, an object of the invention to solve the above mentioned drawbacks of the prior art.

That is, the invention lies in that support bases are supplied just beneath an extrusion molded body through a support base supply means and transferred onto a transporting passage together with the extrusion molded body, during which the moving speed of the extrusion molded body placed on the support bases is detected by a speed sensor and also the cutting interval for the extrusion molded body is detected by an interval detecting means, whereby a cutting tool is transferred toward the moving direction of the extrusion molded body to cut the extrusion molded body based on the moving speed of the extrusion molded body detected by the speed sensor and the detected signal of the interval detecting means in a cutting means for the extrusion molded body.

According to the invention, the support bases are automatically supplied by the support base supply means, whereby the extrusion molded body is automatically transferred to a position of the cutting means.

In the cutting means, the extrusion molded body is cut through the cutting tool based on the signal for the cutting interval of the extrusion molded body detected by the interval detecting means and the moving speed of the extrusion molded body detected by the speed sensor, whereby the cut surface is never made slanting.

It need scarcely be said that the invention more improves the cutting operation efficiency of the extrusion molded body and is possible to be easier in the mass production.

BRIEF DESCRIPTION OF THE DRAWINGS

The invention will be described with reference to the accompanying drawings, wherein.

DESCRIPTION OF THE PREFERRED EMBODIMENTS

Figure 1:
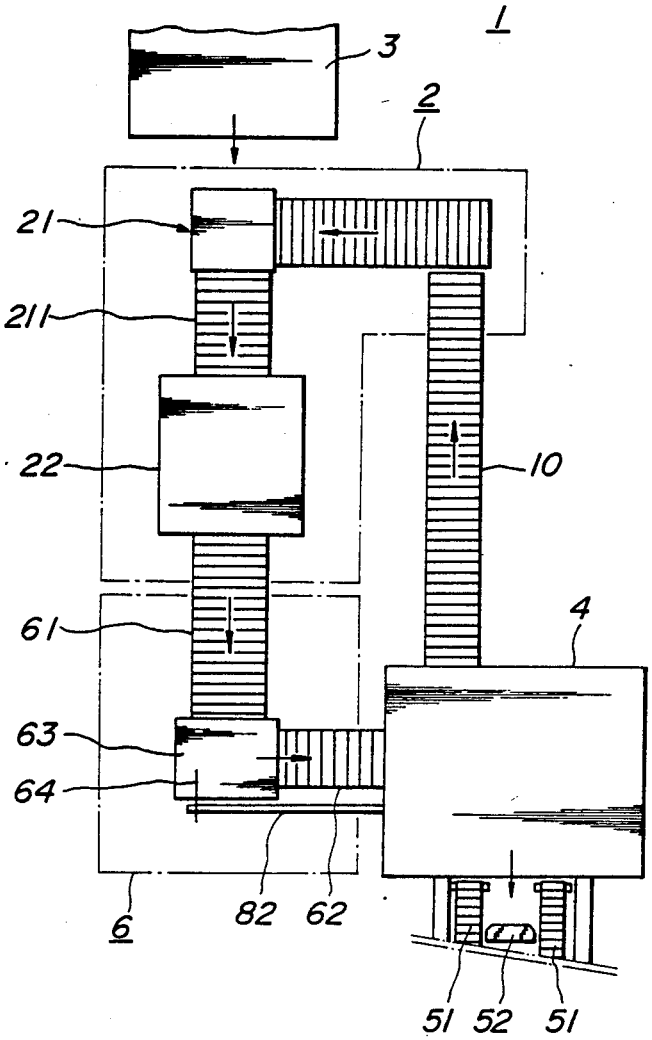
FIG. 1 is a plan view illustrating an outline of an automatic cutting and transferring apparatus including an embodiment of the invention.

In FIG. 1 is shown an outline of an automatic cutting and transferring apparatus 1 for extrusion molded bodies including an embodiment of the automatic cutting apparatus 2 according to the invention.

This automatic cutting and transferring apparatus 1 is an automation system of cutting and transferring the extrusion molded body for ceramic honeycomb structures, which generally comprises an automatic cutting apparatus 2 for cutting an extrusion molded body 200 (shown in FIG. 2) extruded from a die of an extruder 3 and supported on a support base (shown in FIG. 2) into single parts 201, a conveying means for transferring plural support bases 300 supporting the single parts 201 after the cutting, a posture reversing means 4 for changing postures of a group of single parts 201 transferred through the conveying means 6 into a direction perpendicular to the transferring direction, a drying means (not shown) for drying the posture-reversed single parts 201, and a support base return conveyer 10 for returning the support bases 300 left from the posture reversing means 4 to a support base supply means 21.

The automatic cutting apparatus 2 comprises the support base supply means 21 and a cutting means 22.

As shown in FIG. 1, the support base supply means 21 is provided with a roller conveyor 211. The support base 300 moves on the roller conveyor 211 while supporting the extrusion molded body.

Figure 2:
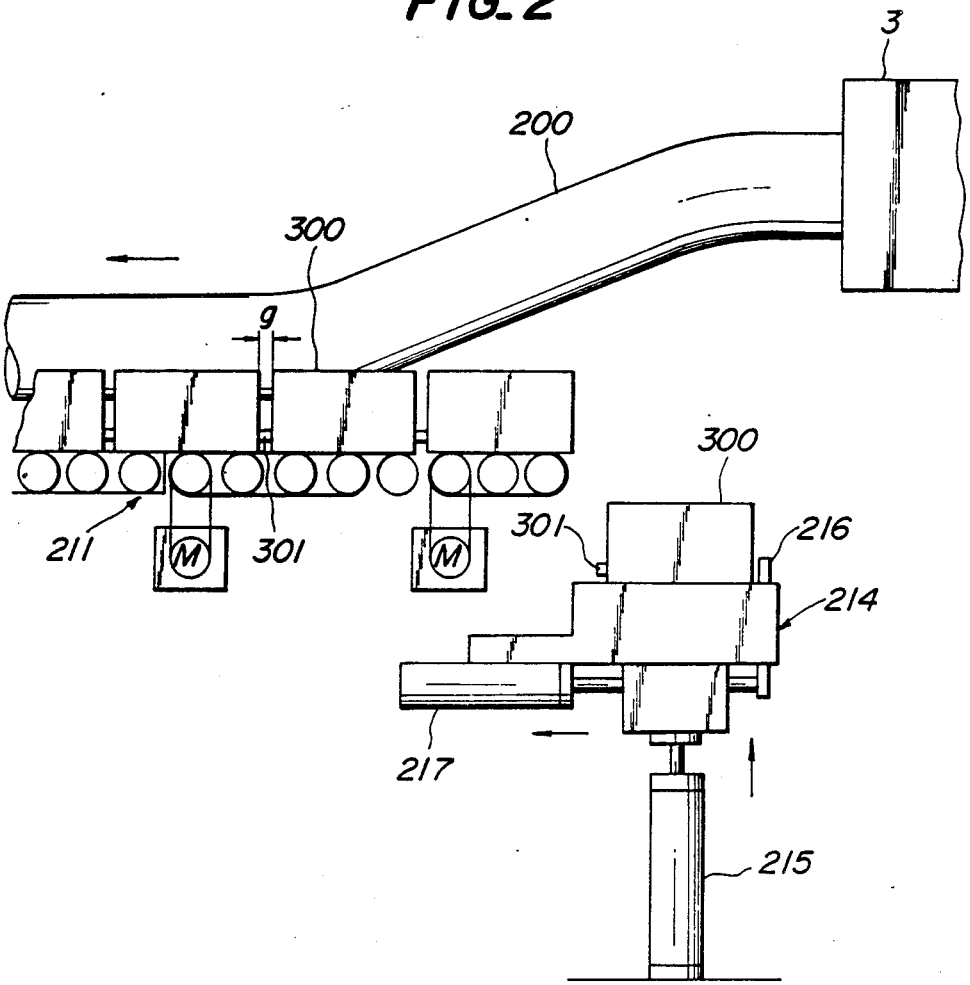
FIG. 2 is a partial side view of a support base supply means.

At the starting end of the roller conveyor 211 is arranged a support base lifter 214 as shown in FIG. 2, which is moved in up and down directions by a hydraulic-actuated means 215 located below the lifter.

In the interior of the support base lifter 214 is disposed a supply base feeding plate 216. This feeding plate 216 feeds the support base toward the conveyor 211 while being contacted with one face of the support base by another hydraulic-actuated means 217.

Further, optical sensors (not shown) are arranged in optional positions at both sides of the roller conveyor 211 so as to detect the passage or existence of the support base.

The operation of the support base supply means 21 will be described below.

In FIG. 2 is shown a state that the support base lifter 214 is descended downward.

The support base lifter 214 is moved in up and down directions at a given cycle by the hydraulic-actuated means 215.

Then, the support base lifter 214 is lifted from the descended state to the position of the roller conveyor 211 through hydraulic actuation.

When the support base lifter 214 arrives at the position of the roller conveyor 211, the support base feeding plate 216 is driven by the actuation of the hydraulic-actuated means 217 and moved toward left side in FIG. 2 to push and transfer the support base 300 existent on the support base lifter 214 onto the roller conveyor 211. Thereafter, the support base lifter 214 is again descended to receive a next support base 300. Such an operation is repeated at a given cycle.

The support base 300 pushed from the support base lifter 214 onto the roller conveyor 211 is forcedly advanced forward by a group of rollers driven through a motor to contact with a back face of a front support base 300, at where it stands by to support the extrusion molded body 200.

Figure 3:
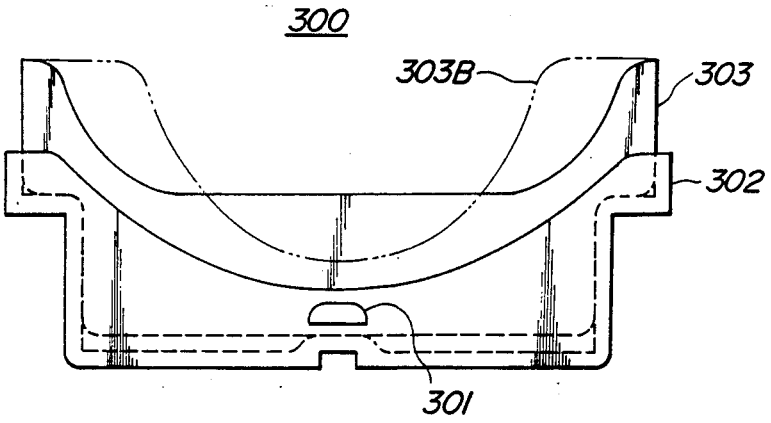
FIG. 3 is an elevational view of a support base.
Figure 4:
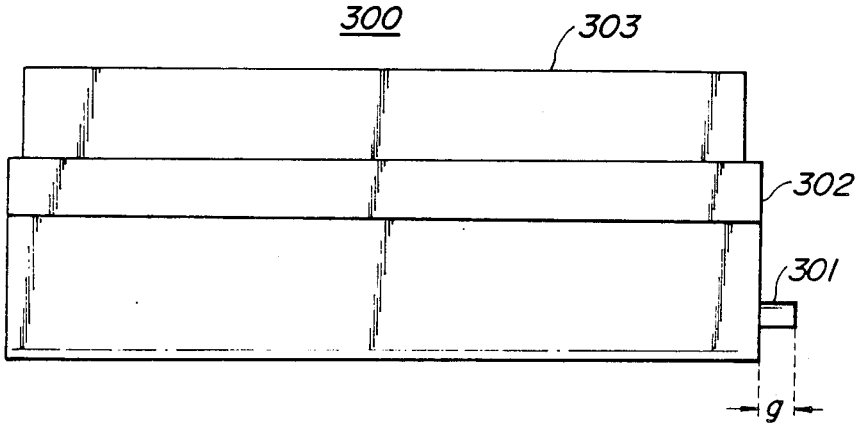
FIG. 4 is a side view of the support base.

As shown in FIGS. 3 and 4, the support base 300 comprises a housing 302, and a supporting member 303 housed therein and having a concave shape corresponding to a lower half profile of the extrusion molded body 200. Since there are provided plural kinds of supporting members 303 having different shapes corresponding to profiles of extrusion molded bodies 200, it is sufficient to replace the supporting member 303 with the other one when changing the profile of the extrusion molded body 200. For instance, the supporting member shown by a solid line in FIG. 3 corresponds to an ellipsoidal profile of the extrusion molded body 200, while a phantom line 303B of FIG. 3 corresponds to a circular profile.

To the front face of the support base 300 is attached a spacer 301 having a given length g. This spacer is required to always form a gap between the support bases 300 when the support bases move on the roller conveyor 211. As shown in FIG. 2, the spacer 301 is contacted with a front support base to give a gap of given length g between the support bases, whereby plural support bases are transferred on the roller conveyor 211 in succession.

In the support base supply means 21, the support bases 300 are successively supplied beneath the extrusion molded body 200 to support the advancing extrusion molded body thereon. Thus, the extrusion molded body 200 supported on the support bases 300 is transferred on the roller conveyor 211 together with these support bases 300 and supplied to the subsequent cutting means 22.

Figure 5:
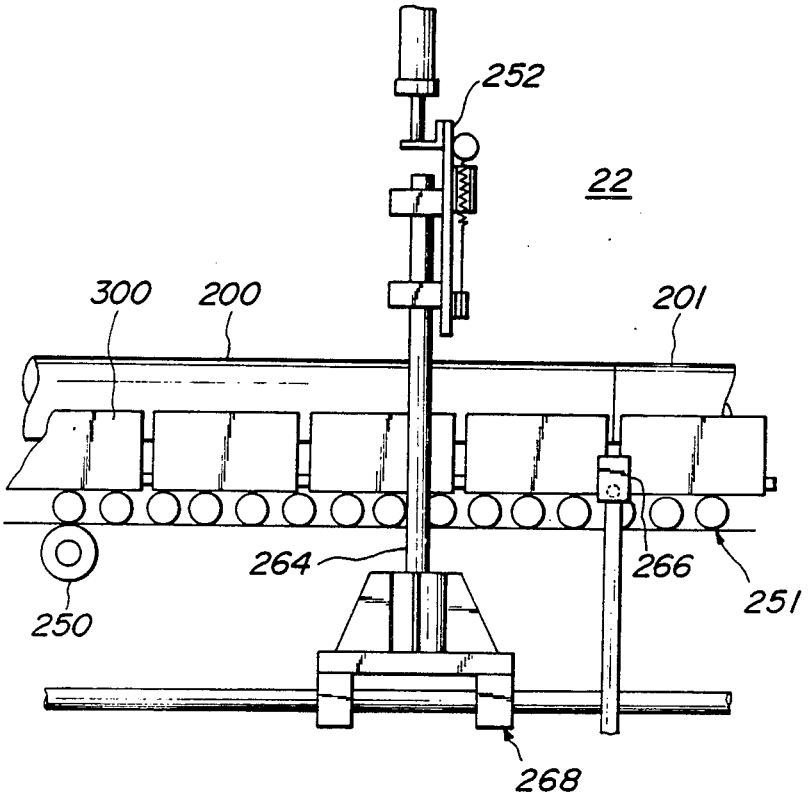
FIG. 5 is a side view of a cutting means.

As shown in FIG. 5, a roller conveyor 251 is connected with the roller conveyor 211 of the support base supply means 21 in the cutting means 22. Two struts 264, 265 are stood at given positions on both sides of the roller conveyor 251, and a cutting frame 252 is arranged to step over the roller conveyor 251 while being supported by the struts 264, 265.

Furthermore, an encoder 250 is arranged side the roller conveyor 251 at a position behind the cutting frame 252 (toward the extruder 3). This encoder 250 is to detect the moving speed of the extrusion molded body 200, wherein a rotational speed of a roller in the roller conveyor 251 is first detected and then the moving speed of the extrusion molded body is calculated from the detected value.

Figure 6:
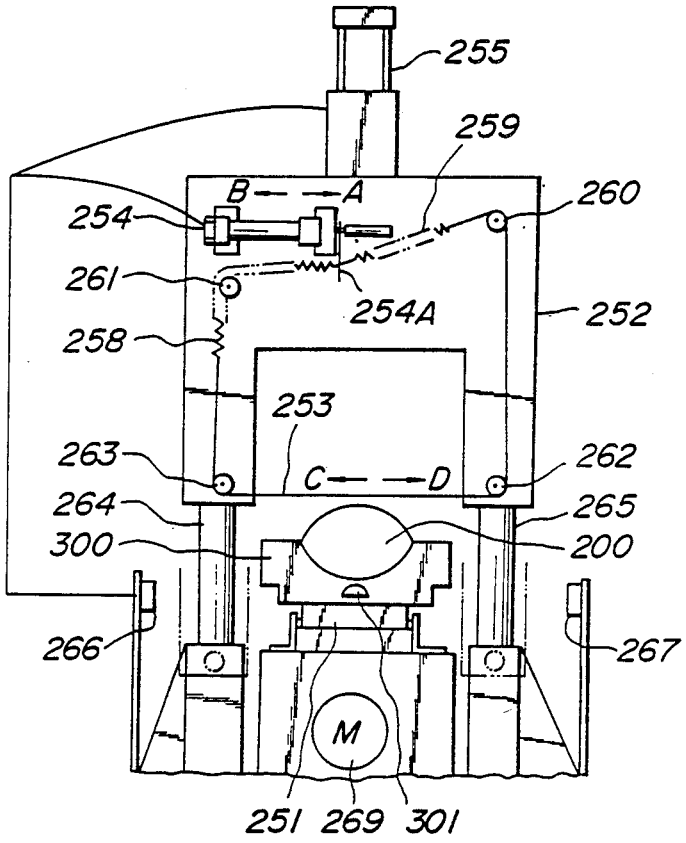
FIG. 6 is an elevational view of the cutting means.

FIG. 6 is an elevational view of the cutting means 22 viewed from right-hand side of FIG. 5.

As shown in FIG. 6, the cutting frame 252 is provided on its front face with four rolls 260–263, a cylinder 254 and a steel wire (for example, 0.1–0.05 mm in diameter) extending about the rolls 260–263 as a cutting tool for cutting the extrusion molded body.

The cutting frame 252 is moved in up and down directions by an elevating cylinder 255.

To both free ends of the steel wire 253 are joined one ends of two springs 258, 259 having different spring constants, respectively, while the other ends of these springs are fixed to an actuator 254A of the cylinder 254. Therefore, the steel wire 253 forms a ring taking the actuator 254A as starting and end points.

Furthermore, two photoelectric switches 266, 267 are arranged in opposition to each other on both sides of the roller conveyor 251 below the cutting frame 252. These photoelectric switches 266, 267 detect the passage of the gap g between the support bases.

Moreover, the two struts 264, 265 are moved in parallel with each other forward and backward by a feed mechanism 268.

The operation of the cutting means 22 will be described below.

When the support bases 300 transferred from the support base supply means 21 together with the extrusion molded body 200 pass across the photoelectric switches 266, 267, the gap g between the support bases is detected by the photoelectric switches, and the detected signal based on the passage timing begins to descend the cutting frame 252.

The descendant timing of the cutting frame 252 is so controlled that the position of the steel wire 253 first contacting with the top surface of the extrusion molded body 200 is existent in a plane including the gap g in the descending of the cutting frame 252. That is, this control is performed by operations taking the passage timing of the gap g as well as the moving speed of the extrusion molded body 200 detected by the encoder 250.

The cutting of the extrusion molded body 200 is carried out by descending the cutting frame 252 to cut the steel wire 253 into the body 200. In this case, the feed mechanism 268 is driven by the actuation of a D.C. servomotor 269, whereby the cutting frame 252 is moved in the moving direction of the extrusion molded body 200 at a speed equal to the moving speed of the body 200 detected by the encoder 250. Thus, the cut surface of the extrusion molded body 200 through the steel wire 253 is rendered into a plane perpendicular to the moving direction of the body 200.

Since the extrusion molded body 200 is a green body for ceramic honeycomb structure and is soft, there is a fear that the honeycomb structure is broken when a small force is applied to the body, so that the draw-cut operation similar to the conventional manual operation is adopted as a motion of the steel wire 253 in the cutting means 22. That is, according to the invention, the cutting is not carried out by pushing the steel wire 253 against the extrusion molded body 200, but the draw-cutting is carried out by pushing the steel wire 253 against the extrusion molded body 200 and at the same time reciprocatedly moving the steel wire 253 in the radial direction of the body 200.

This draw-cut operation will be described with reference to FIG. 6.

Just before the steel wire 253 is contacted with the extrusion molded body 200 by descending the cutting frame (or before the beginning of the cutting), the cylinder 254 is actuated to gradually push the actuator 254A toward a direction of arrow A.

As a result, the steel wire 253 is pulled in a direction of arrow C by the spring 258 and pushed onto the extrusion molded body 200 while sliding during the descending of the cutting frame 252. In this case, a slide member may be arranged in the cutting frame 252 to bring the roll 262 down from a position higher than the level of the roll 263 through the slide member, whereby the steel wire 253 may be diagonally cut into the extrusion molded body.

Since a given elasticity is applied to the steel wire 253 by the springs 258 and 259, when the steel wire 253 is contacted with the extrusion molded body 200, it becomes curved in correspondence with the profile of the extrusion molded body 200, and consequently the pushing force is gentler as compared with a case of pushing the steel wire 253 under a tension, which can prevent the deformation of the extrusion molded body 200 due to excessive force.

In this way, the cutting of the extrusion molded body 200 is started and then completed when the cutting frame 252 arrives at the lowest position. At this time, the pushing operation of the actuator 254A in the cylinder 254 is stopped, and thereafter started to gradually return to the opposed direction (i.e. direction of arrow B in FIG. 6).

Then, the cutting frame 252 frames returns upward to the original position.

Thus, the cutting means 22 can perform the cutting of the extrusion molded body 200 every the gap g between the support bases, so that a single part 201 is produced at a supported state every the support base 300. Therefore, the length of the support base 300 is previously designed to be approximately equal to the cut length of the extrusion molded body 200.

The conveying means 6 is arranged in the front of the roller conveyor 251 in the cutting means 22, and provided with a roller conveyor 61 transferring the support bases 300, each of which supports the single part 201 of the extrusion molded body left from the cutting means 22, in the same direction at a high speed.

The roller conveyor 61 acts to separate the cut surface of the single part 201 from the opposed cut surface of the next single part among the single parts continuously transferred from the cutting means 22.

When the support base 300 transferred on the roller conveyor 61 together with the single part 201 arrives at a stand-by table 63 located at the front end of the conveyor 61, it is pushed away onto a roller conveyor 62 through a push plate 64.

The push plate 64 is moved along a guide rail 82 to the front end of the conveyor 62 every the pushing of fifth support base 300 (with the single part 201) onto the conveyor 62, to transfer the five support bases 300 as a group onto a support table 41 for the support base in the posture reversing means 4, and then returned backward to the original position.

The posture reversing means 4 is a device wherein the single part 201 supported on the support base 300 is stood up by 90° to change the cut surface into up and down directions and simultaneously placed on a carrier 400 for feeding the single parts 201 into a drying means (not shown).

Figure 7:
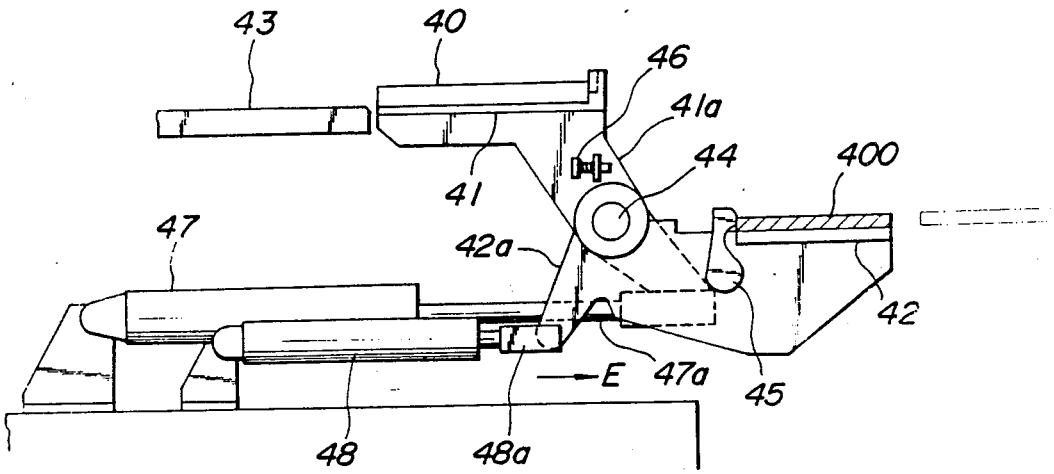
FIG. 7 is a side view illustrating support table and carrier support table in a posture reversing means in FIG. 1.

As shown in FIG. 7, the posture reversing means 4 comprises a support table 41 for temporarily supporting a group of support bases transferred from the conveyor 62, a carrier support table 42 arranged side by side therewith and supporting a carrier 400, and a return table 43 supporting empty support bases after the transference of single parts 201.

The support table 41 is rotatably connected to the carrier support table 42 through a common shaft 44 passing an arm portion 41*a* of the table 41 and an arm portion 42*a* of the table 42. The table 41 is pivoted through a cylinder 47 for the rotation of the support table 41 connected to the nose part of the arm portion 41*a*, while the table 42 is pivoted through a cylinder 48 for the rotation of the support table 42 connected to the nose part of the arm portion 42*a*.

Onto the carrier support table 42 is supplied a carrier 400 by a carrier lifter 52 and an up-down conveyor 51 (both shown in FIG. 1) every one cycle. This carrier 400 is positioned by a carrier stopper 45 disposed on the carrier support table 42.

The up-down conveyor 51 acts to feed the carrier 400 onto the carrier support table 42 through a conveyor belt of the conveyor 51 when the carrier lifted by the carrier lifter 52 is contacted with the conveyor belt at the lower side of the conveyor. And also, the up-down conveyor 51 serves to transfer the carrier 400 together with single parts 201 from the carrier support table 42 to the drying means at the upper surface of the conveyor belt.

The operation of the posture reversing means 4 will be described below.

The original state of the posture reversing means 4 is a state that the supporting face of each of the support table 41 and the carrier support table 42 is directed upward as shown in FIG. 7. As this state, the up-down conveyor 51 is rendered into an up state, while a carrier 400 is lifted up by the carrier lifter 52, whereby the carrier 400 is placed on the carrier support table 42. This carrier 400 has a length enouh to support a group of support bases at once.

Figure 8:
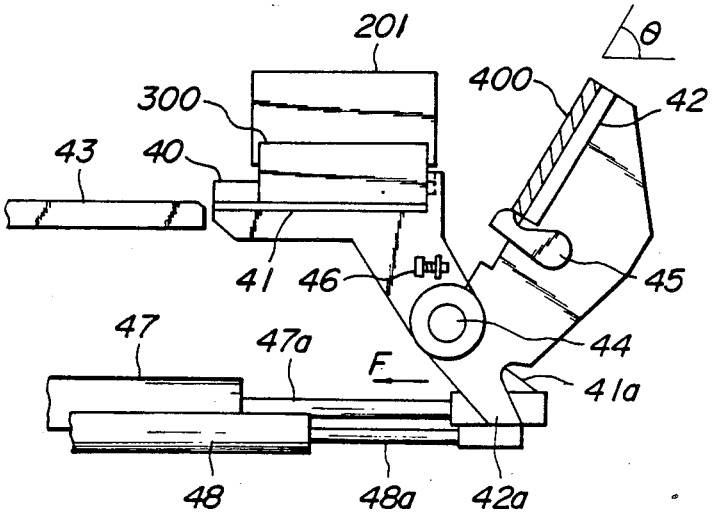
FIGS. 8–10 are operational diagrams for the support table and carrier support table, respectively.

After the carrier 400 is placed on the carrier support table 42, the cylinder 48 is actuated to expand a cylinder rod 48*a* toward a direction of arrow E, whereby the table 42 is pivoted through the common shaft 44 to tilt the supporting face for the carrier 400 as shown in FIG. 8. When the tilting angle $\theta$ reaches 60°, the pivoting of the table 42 is stopped, while the up-down conveyor 51 is returned downward from the up state to the original horizontal state and stood to subsequent procedure.

Then, a group of support bases 300 (i.e. five support bases having single parts) is transferred from the conveyor 62 onto the support table 41. Thereafter, a chucker (not shown) arranged in one end of the support table 41 is moved to contact with this side face of the support base, whereby the support base group is chucked (or clamped) between the chucker and a stopper 40 located in the other end of the support table 41.

Next, the cylinder 47 is actuated to contract a cylinder rod 47*a* toward a direction of arrow F in FIG. 8, whereby the support table 41 is pivoted toward a direction of the tilted carrier support table 42 through the common shaft 44.

Figure 9:
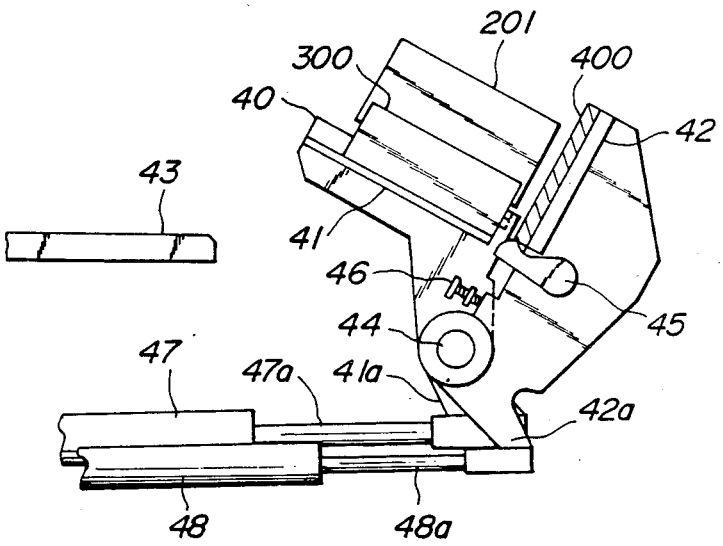

When the support table 41 is tilted at an angle of 30°, as shown in FIG. 9, a top of a table stopper 46 disposed on the side face of the arm portion 41*a* of the support table 41 contacts with the arm portion 42*a* of the carrier support table 42. In this case, the supporting face of the table 41 becomes perpendicular to the supporting face of the table 42. Thus, the cut surface of the single part 201 supported on the support base 300 is parallel to the supporting face of the carrier support table 42, and the cut surface facing the table 42 approaches to the carrier 400.

When the cylinder rod 47*a* of the cylinder 47 is further contracted to pivot the support table 41, the carrier support table 42 is further pivoted together with the support table 41 because the table 42 is pushed by the table stopper 46. In this case, the driving force of the cylinder 48 is adjusted to be smaller than that of the cylinder 47.

Therefore, the tables 41 and 42 are pivoted together while maintaining the supporting faces thereof at right angle state. When the table 41 is tilted from the initial position by 90°, the pivoting of the table 41 is stopped.

Figure 10:
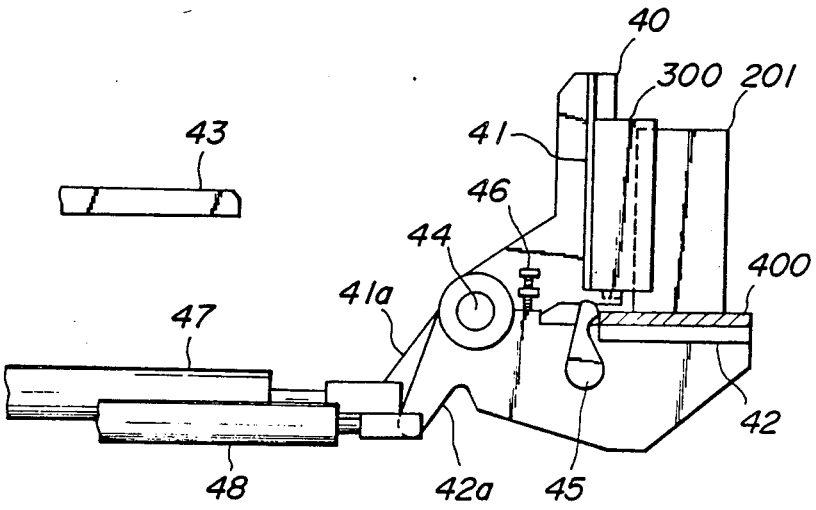

At this time, the single part 201 slides downward from the support base 300 because of the dead weight to stand on the carrier 400 as shown in FIG. 10. That is, the cut surface of the single part 201 is changed into up and down directions as apparent from FIG. 10.

Then, the cylinder rod 47*a* of the cylinder 47 is expanded to the initial position to return the support table 41 to the original state. In this case, only the empty support base group is supported on the support table 41 through the chucker.

After the chucker is released, the empty support base group is pushed away onto the return table 43 behind the support table 41 by a proper means (not shown).

The empty support base group pushed onto the return table 43 is transferred onto the support base return conveyor 10 shown in FIG. 1 to return to the support base supply means 21.

On the other hand, a group of single parts 201 supported on the carrier 400 is transferred together with the carrier 400 onto the up-down conveyor 51 and a stock conveyor (not shown) connecting thereto to feed into the drying means located at the front of the stock conveyor. When the carrier 400 is pushed into the entrance of the drying means, a push pawl of a carrier pushing means (not shown) is raised up to forcedly push the carrier 400 into the drying means.

The reason on the arrangement of the posture reversing means 4 will be described below.

In the manufacture of ceramic honeycomb structures, when the single parts after the cutting of the extrusion molded body are dried in the drying means, they have hitherto been placed onto the carrier by manual operation because it is effective to direct the cut surface of the single part for the ceramic honeycomb structure in up and down directions so as to easily evaporate water contained in the honeycomb structure through holes formed in the structure in order to efficiently dry this structure.

However, the single part for the ceramic honeycomb structure is a green shaped body and is very soft and has a minute honeycomb structure with thinner partition walls, so that the above manual operation has drawbacks that the honeycomb structure is broken or deformed in the handling and the yield and operation efficiency are poor, which become a factor of obstructing the mass production.

In order to automate the above operation, therefore, it is required to take the aforementioned posture reversing means 4. The arrangement of such a means 4 can transfer a great number of single parts onto the carrier at once without deforming or breaking the single part, whereby the yield can be increased and the mass production can be attained easily.

Although the embodiment of the invention has been described with respect to the manufacture of the ceramic honeycomb structure, the material to be cut is not limited to the extrusion molded body for ceramic honeycomb structure. For instance, it is obvious that the invention is applicable to the cutting of extrusion molded bodies made from clay, synthetic resin and the like.

As previously mentioned in detail, according to the invention, the support bases are automatically supplied from the support base supply means just beneath the extrusion molded body and transferred to the cutting means, and the extrusion molded body is cut by the cutting tool in the cutting means moved in synchronization with the moving speed of the extrusion molded body, whereby the cutting can be performed accurately without slanting the cut surface.

Further, the cutting operation for the extrusion molded body can be performed at a high speed with a high accuracy, resulting in the mass production and the increase of yield. Moreover, the length of the support base is substantially matched to the cut length of the extrusion molded body and the cutting of the extrusion molded body is carried out at the gap portion between the support bases, so that the cut length is always constant and the cutting accuracy is high.

What is claimed is:

1. An automatic cutting apparatus for extrusion molded bodies comprising:

support base supply means for supplying support bases just beneath said extrusion molded body extruded from an extruder and transferring said support bases supporting said body onto a transporting conveyor;

a speed sensor for detecting a moving speed of said body on said support bases transferred from said support base supply means onto the transporting conveyor;

interval detecting means provided midway on said transporting conveyor for detecting a cutting interval for said body; and cutting means including a cutting tool arranged on said transporting conveyor upstream of said interval detecting means for cutting said body continuously transferred along said transporting conveyor into a predetermined length perpendicularly to a moving direction of said body with said cutting tool being moved in said moving direction at a speed equal to that of said body detected by said speed sensor and cutting said body in response to a signal detected by said interval detecting means.

2. The apparatus according to claim 1, wherein said interval detecting means detects an interval between said support bases.

3. The apparatus according to claim 1, wherein said support base has a length equal to a length of a single part cut from said extrusion molded body.

* * * * *